US005706870A

United States Patent [19]

Maerzke

[11] Patent Number: 5,706,870

[45] Date of Patent: Jan. 13, 1998

[54] KIT AND METHOD FOR REFILLING INK CARTRIDGES

[75] Inventor: James T. Maerzke, Kenosha, Wis.

[73] Assignee: Procubed Corp., Kenosha, Wis.

[21] Appl. No.: 643,338

[22] Filed: May 6, 1996

[51] Int. Cl.[6] ..... B65B 3/00

[52] U.S. Cl. ..... 141/18; 141/2; 141/5; 141/26; 53/468; 53/489; 347/85

[58] Field of Search ..... 141/2, 5, 18, 21, 141/25, 26; 53/468, 489; 347/85, 86, 87

[56] References Cited

U.S. PATENT DOCUMENTS

| | | | |
|---|---|---|---|
| 4,731,978 | 3/1988 | Martensson | 53/468 |
| 5,027,872 | 7/1991 | Taylor et al. | 141/18 X |
| 5,199,470 | 4/1993 | Goldman | 141/1 |
| 5,329,294 | 7/1994 | Ontawar et al. | 397/87 |
| 5,400,573 | 3/1995 | Crystal et al. | 53/468 |
| 5,479,968 | 1/1996 | Sanchez et al. | 141/2 X |
| 5,495,877 | 3/1996 | Schwenk et al. | 141/18 X |
| 5,515,663 | 5/1996 | Allgeier, Sr. et al. | 53/468 X |
| 5,537,134 | 7/1996 | Baldwin et al. | 347/85 |

*Primary Examiner*—J. Casimer Jacyna

[57] ABSTRACT

The invention relates to an improved apparatus and method of refilling an ink jet cartridge used with printers. The kit includes a plug pulling tool, and an amount of ink contained in a syringe-plunger assembly with a cap. The plug pulling tool allows removing a plug from a cartridge without damage, so that the plug can be replaced into the cartridge after being refilled. The syringe-plunger assembly allows the user to seal the nozzle of the syringe tight against the hole in the cartridge, in order to fill the cartridge with ink as well as to remove unwanted air from inside the cartridge. The invention eliminates the need of having to reseal the cartridge by alternate means, allows venting of the cartridge reservoir during the refill process, and significantly increases the efficiency and cleanness of refilling an ink jet cartridge.

4 Claims, 4 Drawing Sheets

KIT AND METHOD FOR REFILLING INK CARTRIDGES

BACKGROUND OF THE INVENTION

The invention relates to an improved kit and method for refilling an ink cartridge used mostly with ink jet printers. The kit comprises a tool to pull the vent plug from a cartridge, creating a port in which to fill the cartridge with ink. The plug can then be replaced into the cartridge, resealing it to eliminate leakage. The kit also contains a syringe-plunger assembly, filled with ink and sealed with a cap. The syringe-plunger allows the user to; first, seal the tapered nozzle of said syringe against the hole; second, control the flow of ink entering a cartridge through the aforementioned port; and third the user can retract the plunger, drawing unwanted air from a cartridge to vent the ink reservoir, thus allowing the refilling process to continue easily and effectively until complete.

U.S. Pat. No. 5,199,470 to Barry M. Goldman has a prior art device described for refilling an ink cartridge using a tool that drills a hole into the plug, thus destroying it for future use, and a bellows type bottle, with a thin nozzle, containing the ink to refill a cartridge. Also, provides no venting method.

U.S. Pat. No. 5,329,294 to Susan P Ontawar et al. has prior art device described for making a refillable ink jet cartridge and method for refilling said cartridge. This invention uses a tool to push the plug into a cartridge, thus having to reseal it with an alternate means, and a squeezeable bottle containing ink to refill said cartridge. The venting method is complicated and requires additional apparatus.

An ink cartridge is an expensive item necessary to the operation of printers, and replacement of said cartridge, when its supply of ink has been depleted, is a continual necessity throughout the useful life of a printer. Before the method of refilling ink cartridges was introduced, a new, prefilled cartridge was commercially purchased to replace a cartridge that ran out of ink. It has been proven that an ink cartridge is durable enough to allow refilling it several times before having to replace the cartridge. The means to refill and reuse an ink cartridge significantly reduces the cost of replacing said cartridge, as well as greatly reducing the need to dispose of exhausted cartridges.

A concern with present methods for refilling ink cartridges, is venting of the cartridge while introducing the fresh ink into it. Another concern with present methods is the clearing of a hole in which to introduce the fresh ink, and thus the need to reseal the hole when the cartridge is refilled. The improved kit and method eliminates the above concerns.

SUMMARY OF THE INVENTION

The current invention is an improved method for the process of refilling an ink cartridge, and kit to perform said process. The plug pulling tool is used to remove the plug from a cartridge, the tapered nozzle of the syringe seals against the hole of the cartridge for refilling and venting. This kit and method allows the refilling process to be performed efficiently and with less spillage or underfilling due to trapped air.

The advantage and object of the kit and method is the kit consisting of a plug pulling tool, that the user inserts into the plug in an ink cartridge, and pulls the plug from the cartridge without damage to either component. The syringe-plunger assembly embodies a tapered nozzle that, when inserted into the hole left by the removed plug, will seal tightly into the hole, which may vary in diameter. With the tip sealed completely in the hole, the ink from the syringe-plunger assembly is forced into the cartridge with no spattering. As the ink is pushed into the reservoir of the cartridge, air must be vented. This is performed by retracting the plunger, drawing air from inside the cartridge reservoir. Pushing and retracting the plunger in a pulsing action will allow for complete refill of the cartridge without leakage or spilling. The plug, previously removed, is reinserted into the cartridge to seal the hole, such that no ink will leak out and air flow into the cartridge reservoir is reduced to what was intended.

DETAILED DESCRIPTION OF DRAWINGS

Figure 1:
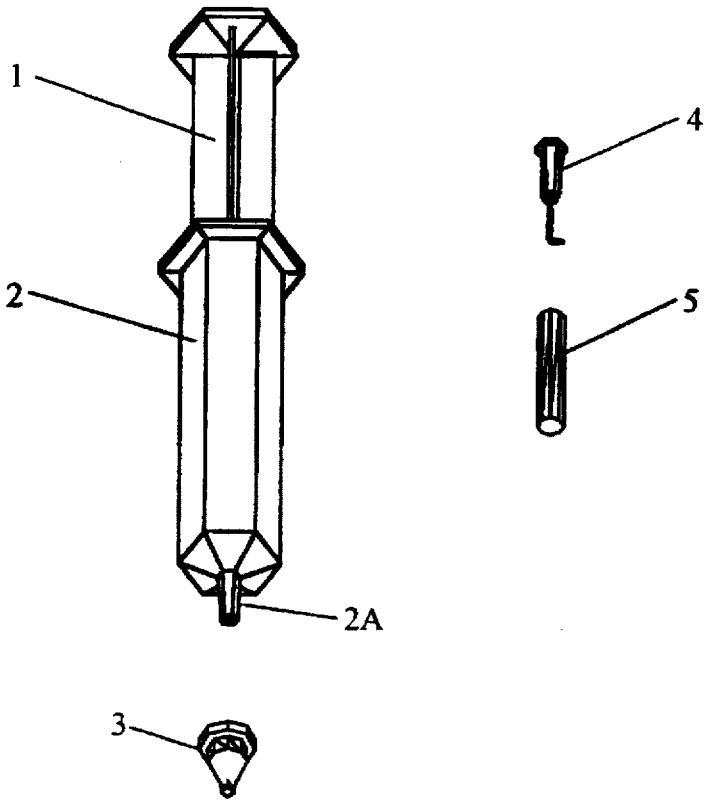
FIG. 1 is a perspective of all of the components of the kit.

In FIG. 1 all components of the kit as described by the invention are shown. The plunger 1 fits inside syringe 2. The cap B is placed over tapered nozzle 2A of syringe 2. In FIG. 1 the plug pulling tool 4 is secured in a holder 5, and fastened to the plunger 1 by means of tape.

Figure 2:
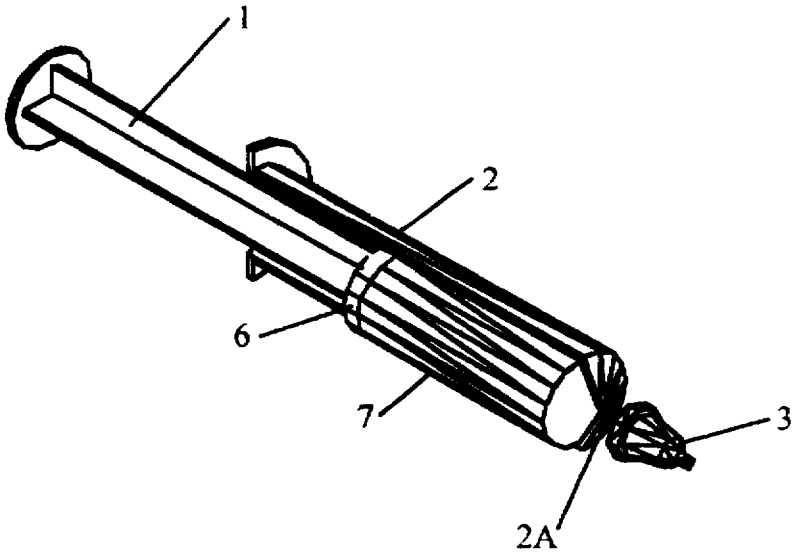
FIG. 2 is an assembly view of the syringe-plunger assembly.

FIG. 2 shows the assembly view of the syringe 2-plunger 1 assembly, with ink 7 contained therein. The syringe 2 and plunger 1 are of rigid plastic material and are obtained from a commercial supplier. The stopper 6 is of rubber material and usually a standard component of the commercially obtained plunger 1. The ink 7 within the syringe 2-plunger 1, is contained by means of the air tight seal of the stopper 6 and the cap 3 over the tapered nozzle 2A of the syringe 2. The cap 3 is of rigid plastic or other rigid material which tightly fits the tapered nozzle 2A, thus preventing leakage of ink 7.

Figure 3:
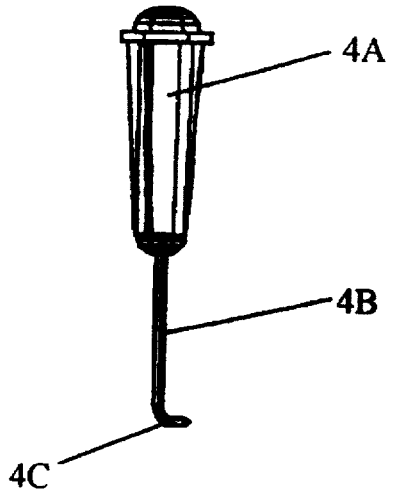
FIG. 3 is an assembly view of the plug pulling tool.

FIG. 3 shows the assembly view the plug pulling tool 4. The handle 4A is of a rigid plastic material and having a inside diameter slightly larger than the outer diameter of the pin 4B. The pin 4B is of a metallic material and is inserted through the shaft of the handle 4A so that the pointed end protrudes out of the handle 4A and the head of the pin is withheld and fixedly secured inside the handle 4A. The pointed tip of the pin 4B is bent to an approximate 90 degree angle, forming a hook 4C. The assembled plug pulling tool 4 is placed inside holder 5, reference FIG. 1, to be fastened to the plunger 1 for packaging purposes.

Figure 4:
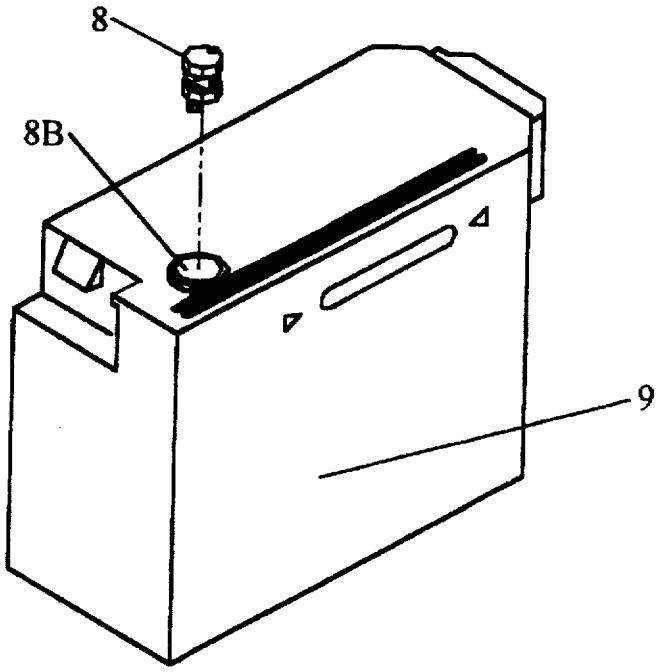
FIG. 4 is a perspective view of the placement of the plug in a cartridge.

FIG. 4 shows the ink jet cartridge 9 used in conjunction with this invention, and the plug 8 dislodged from the hole creating the port through which the ink is injected.

Figure 5:
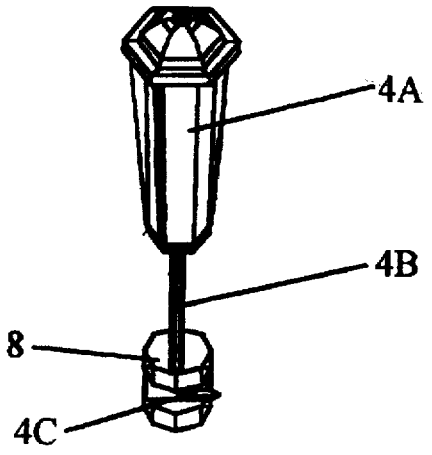
FIG. 5 is a perspective view of method to remove plug from cartridge.
Figure 5:
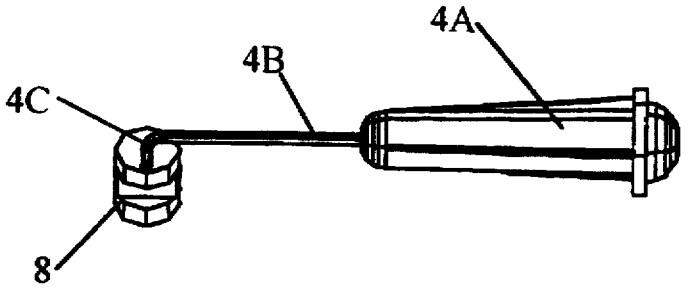

FIG. 5 shows the improved method for removing the plug from the cartridge 9. Inserting the hook 4C of the plug pulling tool 4 into a tiny hole in the plug 8 and rotating it up so as to hook into the plug 8, the plug 8 is then withdrawn from its hole 8B in the cartridge 9 thus leaving a port for the refilling process to take place.

Figure 6:
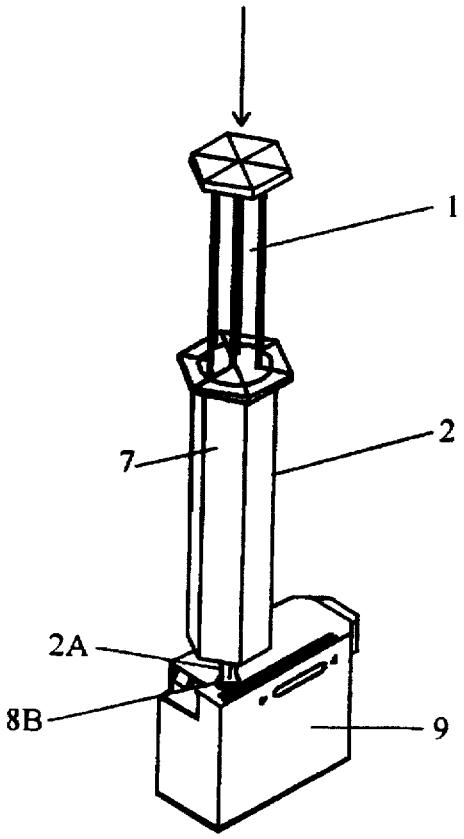
FIG. 6 is a perspective view of the method of sealing the nozzle of the syringe to the hole in the cartridge for refilling with the ink.

FIG. 6 shows the process used for refilling the ink cartridge 9. The cap B is removed from the syringe 2, taking care not to allow leakage of ink 7. The tapered nozzle 2A of syringe 2 is inserted in the hole 8B of the cartridge 9 and pressure is applied to tightly secure the tapered nozzle 2A into the hole 8B. Gently depressing the plunger 1 into the syringe 2 will cause the ink 7 to flow through the tapered nozzle 2A and hole 8B, into the cartridge 9. Observing any ink leaking from the cartridge 9 would make it appear that the cartridge 9 is full. However, the introduction of ink 7 being forced into the cartridge 9 increases the internal pressure. Therefore it is necessary to vent the cartridge 9 in order to continue the refilling process.

Figure 6B:
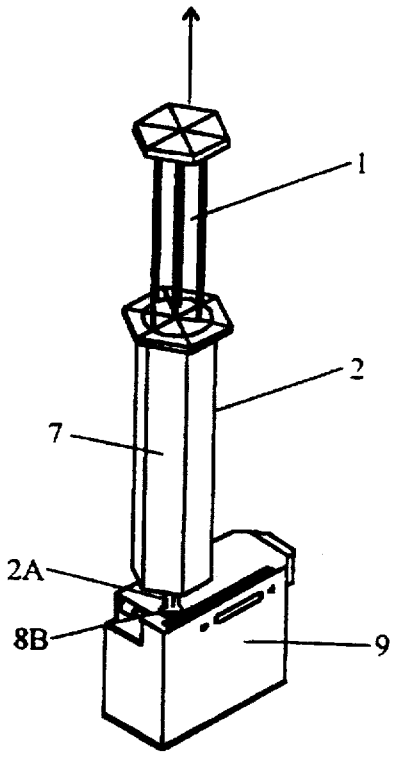
FIG. 6B is a perspective view of the method of drawing air from the cartridge by retracting the plunger.

FIG. 6B shows the retraction of the plunger 1 while still securely placed in the hole 8B. As the plunger 1 is retracted, air bubbles will be observed being drawn into the syringe 2 of ink 7. When flow of air bubbles stops, the plunger 1 is then gently depressed as before to cause flow of ink 7 through the tapered nozzle 2A and port into the cartridge 9. Using a gentle pulsing action of depressing and retracting the plunger 1 in the syringe 2 will cleanly and efficiently fill the cartridge 9. When refilling process is completed the plug 8 is replaced into the hole 8B completely resealing the cartridge 9 and containing the ink 7 therein.

I claim:

1. A kit for refilling an ink cartridge, the kit comprised of:

A. a plug pulling tool adapted to remove a plug from said ink cartridge, said plug pulling tool comprised of:

a handle having an interior tapered shaft, and a pin having a first end secured within said tapered shaft in said handle and protruding from said handle to a second pointed end which is bent to approximately a ninety degree angle to create a hook; and B. a syringe-plunger assembly with ink contained therein adapted for refilling said ink cartridge and venting air from a reservoir of said ink cartridge, comprised of:

a rigid syringe containing ink used during the refilling process, said syringe having a tapered nozzle adapted to be used to seal against a hole left by a plug removed from said ink cartridge, a rigid plunger with a stopper assembled with said syringe to contain said ink, said plunger being used to force said ink into said ink cartridge and to vent air from said ink cartridge reservoir, and a cap fixedly attached to said tapered nozzle of said syringe to contain ink inside said syringe-plunger assembly prior to use.

2. The kit of claim 1 further including a holder made of semi rigid plastic to contain said plug pulling tool prior to use.

3. The kit of claim 1 wherein said pin is metallic, said syringe is plastic, said plunger is plastic and said stopper is rubber.

4. A method for refilling an ink cartridge with ink using the kit of claim 1 which method embodies the steps of removing the plug from an ink cartridge using said plug pulling tool without damage to said plug or cartridge by inserting the hook of the plug pulling tool into the plug of the ink cartridge and rotating the hook upward such that the hook is affixed to the plug, the plug is then pulled up and withdrawn from the cartridge and retained, said cap is then removed from said tapered nozzle of the syringe-plunger assembly, then said tapered nozzle is inserted into the hole of the ink cartridge and pressure is placed on the connection to make a tight seal on the hole, then the plunger is depressed into the syringe forcing the contained ink through the tapered nozzle and into the ink cartridge reservoir, the plunger is then retracted from the syringe thus drawing air from the reservoir to vent the internal pressure of the ink cartridge as it increases, the steps of depressing and retracting the plunger are repeated until the ink cartridge reservoir is completely filled and the plug is replaced into the hole of the cartridge when the filling process is complete in order to securely seal the ink inside the cartridge and to eliminate excess air from entering the cartridge and causing dryness within the cartridge reservoir.

* * * * *